US005800208A

United States Patent [19]

Ishizuka et al.

[11] Patent Number: 5,800,208

[45] Date of Patent: Sep. 1, 1998

[54] MOVABLE CONNECTOR-MOUNTING CONSTRUCTION

[75] Inventors: Shigeo Ishizuka; Isao Kameyama, both of Shizuoka, Japan

[73] Assignee: Yazaki Corporation, Tokyo, Japan

[21] Appl. No.: 685,507

[22] Filed: Jul. 24, 1996

[30] Foreign Application Priority Data

Aug. 1, 1995 [JP] Japan ..... 7-196634

[51] Int. Cl.[6] ..... H01R 13/73

[52] U.S. Cl. ..... 439/557

[58] Field of Search ..... 439/557, 247, 439/552, 554

[56] References Cited

U.S. PATENT DOCUMENTS 4,541,036 9/1985 Landries et al. ..... 439/557
5,199,900 4/1993 Hayes ..... 439/557

FOREIGN PATENT DOCUMENTS 53-8083 7/1951 Japan .
63-125310 8/1988 Japan .
5-61908 8/1993 Japan .

*Primary Examiner*—Khiem Nguyen
*Assistant Examiner*—Eugene G. Byrd
*Attorney, Agent, or Firm*—Morgan, Lewis & Bockius LLP

[57] ABSTRACT

In a movable connector-mounting construction, a mounting hole is formed through a panel on which a movable connector is mounted, and a gap is formed between the edge of the mounting hole and the movable connector so as to allow displacement of the movable connector. Retaining arms are formed on an outer surface of a housing, and displaceably retain the movable connector on the edge of the mounting hole. A pair of protective ribs are formed on the outer surface of the housing, and are disposed respectively on opposite sides of each of the retaining arms, and project outwardly beyond the retaining arm. Notches are formed respectively in those portions of the edge of the mounting hole corresponding respectively to the protective ribs, and each of the notches is larger in size than the protective rib by an amount corresponding to the amount of displacement of the housing.

6 Claims, 4 Drawing Sheets

MOVABLE CONNECTOR-MOUNTING CONSTRUCTION

BACKGROUND OF THE INVENTION

1. Field of the Invention

This invention relates to a construction of mounting a movable connector displaceably on a panel of a vehicle body or the like.

2. Related Art

Examples of connectors include a movable connector which is displaceable so as to absorb misregistration with a mating connector when the two connectors are to be fitted together, so that a good connection between the two connector can be achieved. FIG. 4 is a perspective view showing a conventional movable connector before it is mounted on a panel, and FIG. 5 is a perspective view showing the movable connector mounted on the panel. A connector housing 1 of a rectangular parallelepipedic shape has a front face la, and is inserted into a mounting hole 5 of a rectangular shape formed through a panel 3. The size of the opening of the mounting hole 5 is larger than the outer size of the housing 1. Four retaining arms 7 extend from a rear end of the housing 1 in a direction of insertion of the housing 1 in adjacent relation to upper, lower, right and left faces of the housing 1, respectively, and each of these retaining arms 7 having a retaining pawl 7*a* formed on an outer surface of its distal end. Each retaining arm 7 is spaced from the outer surface of the housing 1, and is elastic, and therefore is displaceable in a direction perpendicular to the connector inserting direction.

Therefore, when the movable connector 9 is inserted in the mounting hole 5 as shown in FIG. 5, the distal ends of the retaining arms 7 pass through the mounting hole 5, and the retaining pawls 7*a* are engaged with that edge portion of the mounting hole 5 facing in the inserting direction, and in this condition the movable connector 9 is mounted on the panel 3, with a gap S formed between the movable connector 9 and the edge of the mounting hole 5 so that the movable connector 9 can be displaced.

When the movable connector 9 of this construction is provided, for example, at a connector connecting portion for an instrument panel, the movable connector 9 is projected from the panel 3 of the body as shown in FIG. 6(*a*), and is opposed to a mating connector 13 projected from the instrument panel (not shown). In this condition, when the instrument panel is fixed to the panel 3, the movable connector 9 is inserted into the mating connector 13. At this time, if the movable connector 9 is out of registry with the mating connector 13, the retaining arms 7 of the movable connector 9, having a tapered surface 15 in contact with a guide surface 17 of the mating connector 13 (see FIG. 6(*b*)), are displaced upward, downward, right and left as the mating connector 13 approaches, thereby absorbing this misregistration, and therefore the movable connector 9 can be positively connected to the mating connector 13 coaxially therewith, as shown in FIG. 6(*c*)).

As described above, the conventional movable connector 9 is mounted on the panel 3 through the displaceable retaining arms 7 so that misregistration, occurring when the movable connector 9 is fitted in the mating connector 13, can be absorbed. Therefore, each retaining arm 7 is much projected from the outer surface of the housing 1, and the gap is provided therebetween so as to absorb the displacement. Therefore, the retaining arms 7 are liable to contact neighboring wire harnesses and other electric parts before and after the movable connector is mounted on the panel 3, and there has been encountered a problem that particularly during the assembling operation, the retaining arm 7 undergoes an external force upon contact with the electric part, and is liable to be damaged.

And besides, when the movable connector 9 is mounted in the mounting hole 5, only the retaining pawls 7*a* are exposed to and engaged with that edge portion of the mounting hole 5 facing in the inserting direction, and therefore if the retaining pawl 7*a* is urged or pressed in its retaining engagement release direction, for example, when mounting the instrument panel, there is a possibility that the retaining engagement of the retaining pawl is easily released.

SUMMARY OF THE INVENTION

The present invention has been made in view of the above problems, and an object of the invention is to provide a movable connector-mounting construction in which retaining arms are prevented from damage by interference with other member, and the retaining arms, once retainingly engaged, are prevented from being accidentally disengaged, thereby enhancing the reliability of the movable connector-mounting construction.

The above object has been achieved by a movable connector-mounting construction of the invention comprising a movable connector; a panel on which the movable connector is mounted, the panel having a mounting hole whose opening has a size larger than an outer size of a housing of the movable connector to provide a gap between an edge of the mounting hole and the housing so as to enable the connector to be displaced; and an elastic retaining arm formed on an outer surface of the housing of the movable connector, and displaceably retaining the movable connector on the edge of the mounting hole; Characterized in that a pair of protective ribs are provided respectively on opposite sides of the retaining arm, and project outwardly from the outer surface of the housing beyond the retaining arm; and notches are formed respectively in those portions of the edge of the mounting hole corresponding respectively to the protective ribs, and each of the notches is larger in size than the protective rib by an amount corresponding to the amount of displacement of the housing.

In this construction, when the movable connector is inserted in the mounting hole, the retaining arm is received in the mounting hole, and is retainingly engaged with the edge portion of the mounting hole, and also the protective ribs are inserted respectively in the notches. Each of the protective ribs, projectingly provided on the opposite sides of the retaining arm, can move in the associated notch since the notch is larger in size than the protective rib by an amount corresponding to the amount of displacement of the housing. Therefore, the protective ribs will not contact the panel, and hence will not prevent the displacement of the housing. In the movable connector thus mounted on the panel, the protective ribs are inserted and extend through the panel, and therefore the retaining arm is covered with the protective ribs over the entire length thereof, thereby preventing a foreign object from contacting the retaining arm.

DETAILED DESCRIPTION OF THE PREFERRED EMBODIMENTS

A preferred embodiment of a movable connector-mounting construction of the present invention will now be described with reference to the drawings.

Figure 1:
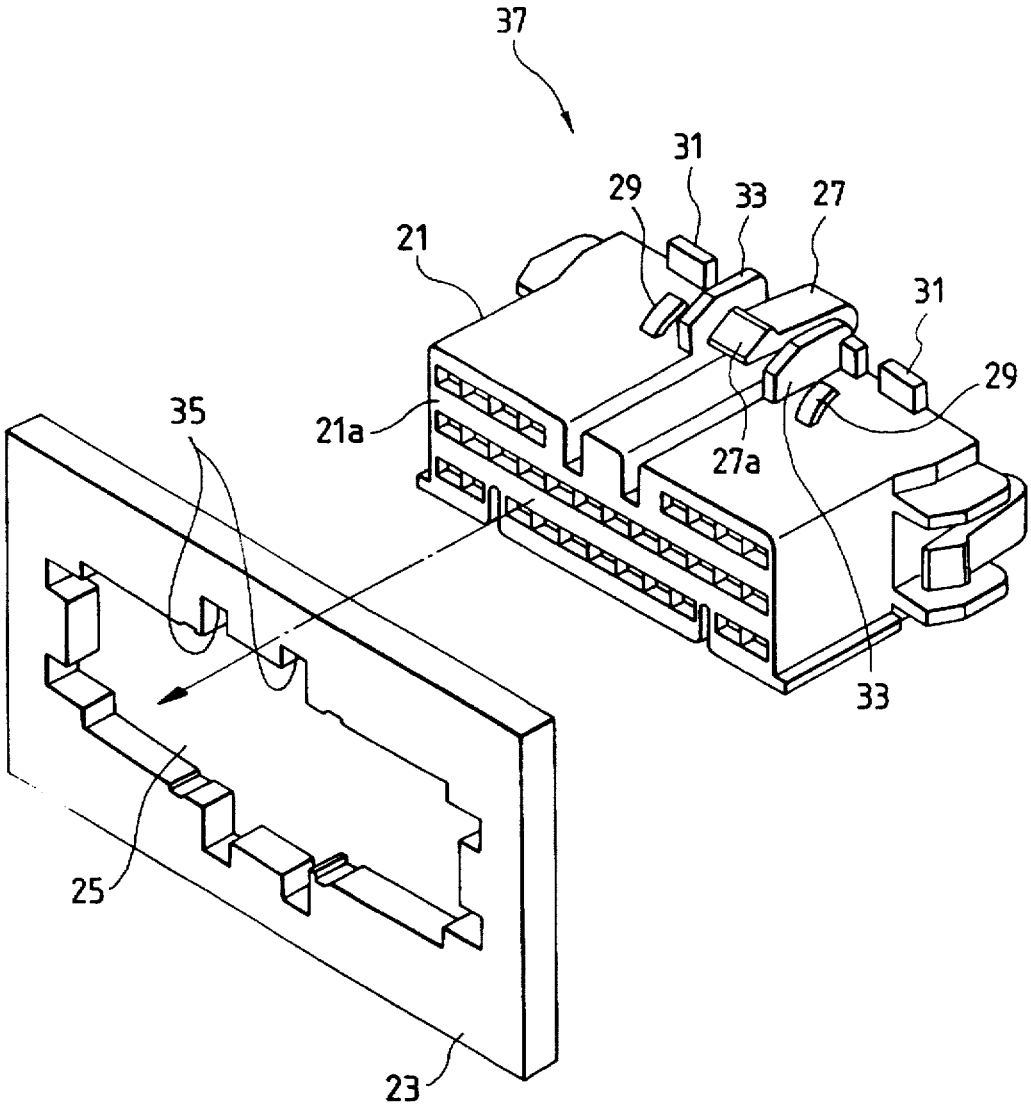
FIG. 1 is an exploded, perspective view of a movable connector-mounting construction of the present invention.
Figure 2:
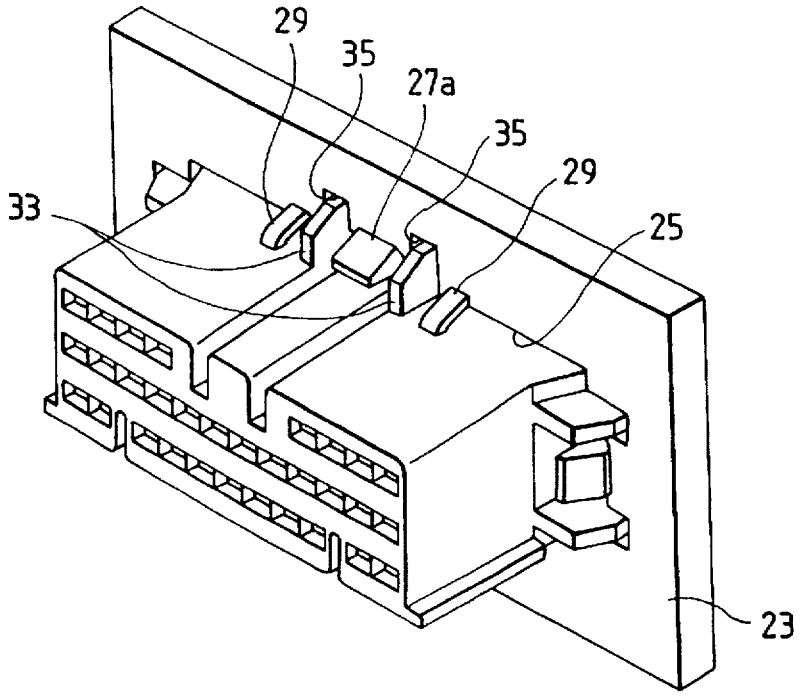
FIG. 2 is a perspective view showing a movable connector of FIG. 1 mounted on a panel.
Figure 3:
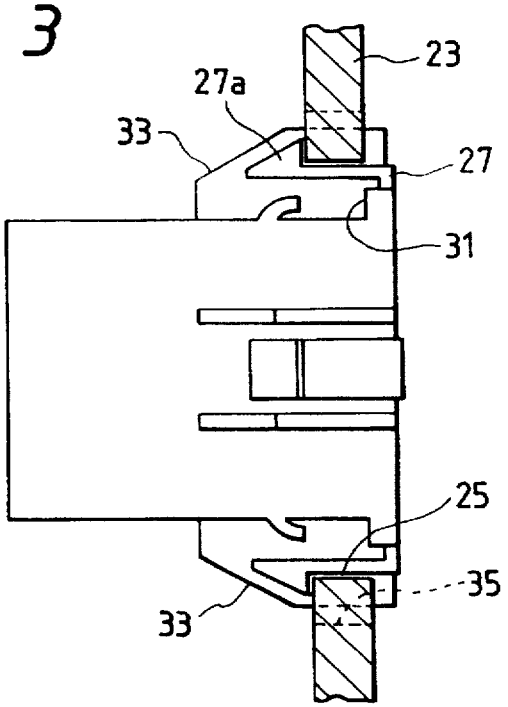
FIG. 3 is a vertical cross-sectional view of the movable connector of FIG. 1 mounted on the panel.
Figure 4:
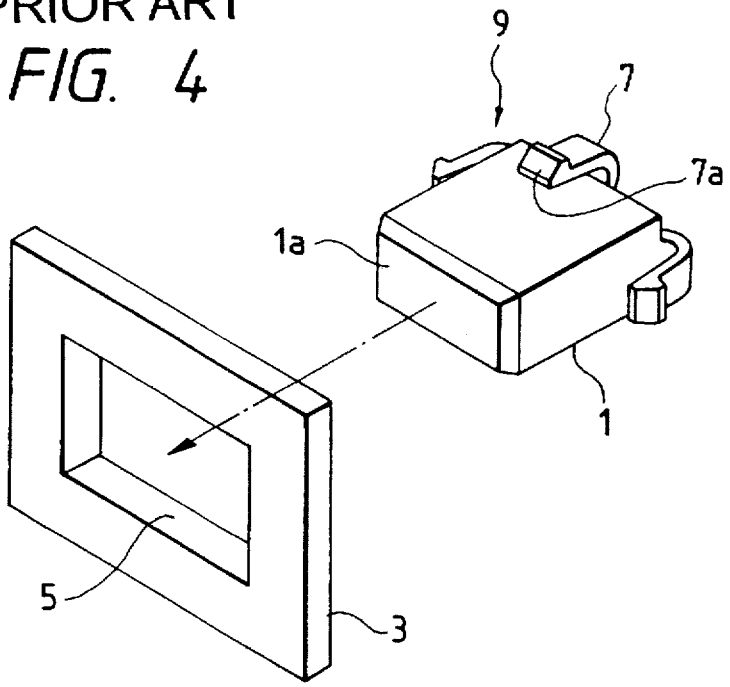
PRIOR ART FIG. 4
FIG. 4 is a perspective view showing a conventional movable connector before it is mounted on a panel.
Figure 5:
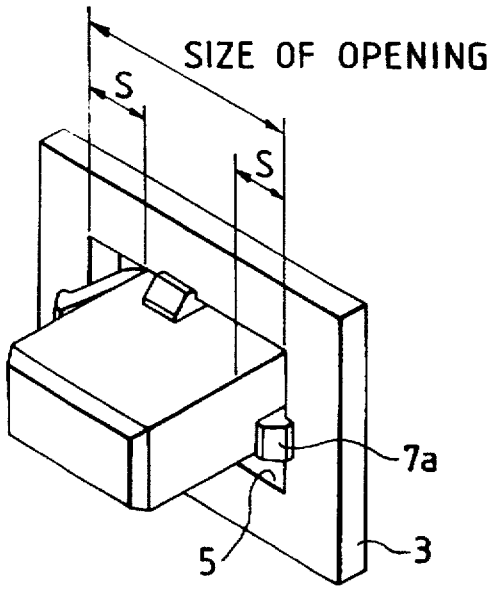
PRIOR ART FIG. 5
FIG. 5 is a perspective view showing the conventional movable connector mounted on the panel.
Figure 6A:
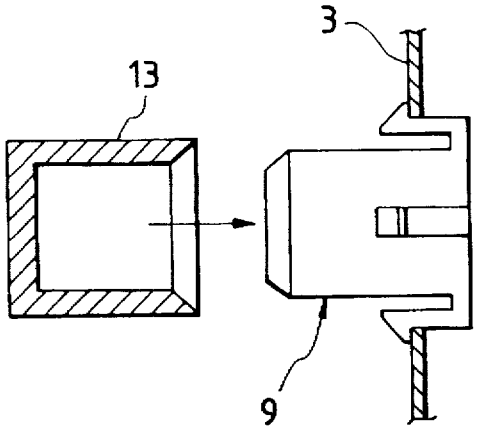
PRIOR ART FIG. 6(a)
FIGS. 6A, 6B and 6C is a view showing the fitting of the conventional movable connector.
Figure 6B:
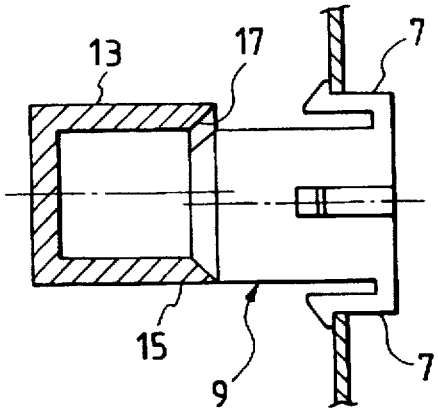
PRIOR ART FIG. 6(b)
Figure 6C:
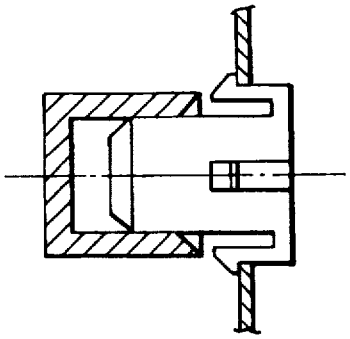
PRIOR ART FIG. 6(c)

FIG. 1 is an exploded, perspective view of the movable connector-mounting construction of the invention, FIG. 2 is a perspective view showing a movable connector of FIG. 1 mounted on a panel, and FIG. 3 is a vertical cross-sectional view of the movable connector of FIG. 1 mounted on the panel.

A connector housing 21, having, for example, a rectangular parallelepipedic shape, has a front face 21*a*, and is inserted into a mounting hole 25 of a rectangular shape formed through the panel 23. The size of the opening of the mounting hole 25 is larger than the outer size of the housing 21. Four retaining arms 27 extend from a rear end of the housing 21 in a direction of insertion of the housing 21 in adjacent relation to upper, lower, right and left faces of the housing 21, respectively, and each of these retaining arms 27 having a retaining pawl 27*a* formed on an outer surface of its distal end. Each retaining arm 27 is spaced from the outer surface of the housing 21, and is elastic, and therefore its distal end, having the retaining pawl 27*a*, is displaceable in a direction perpendicular to the connector inserting direction.

When the housing 21 is inserted in the mounting hole 25, the distal ends of the retaining arms 27 pass through the mounting hole 25, and the retaining pawls 27*a* are engaged with that edge portion of the mounting hole 25 facing in the inserting direction (see FIG. 2), and in this condition the housing is mounted on the panel 23, with a gap formed between the housing and the edge of the mounting hole 25 so that the housing can be moved. A pair of right and left auxiliary pawls 29 are formed on each of the upper and lower faces of the housing 21, and the retaining arm 27 is disposed between these auxiliary pawls 29. When the retaining pawls 27 are retainingly engaged with the edge portion of the mounting hole 25, the auxiliary pawls 29 are also engaged with the edge portion of the mounting hole 25 on that side of the mounting panel 23 with which the retaining pawls 27 are engaged, thereby preventing the housing 21 from being withdrawn in a direction opposite to the direction of insertion of the housing 21.

Stoppers or piece portions 31 are formed perpendicularly on a rear portion of each of the upper and lower faces of the housing 21, and when the housing 21 is inserted in the mounting hole 25, the stoppers 31 are held against that side or face of the panel 23 facing away from the housing-inserting direction, thereby preventing the housing 21 from being withdrawn in the direction of insertion of the housing 21. Therefore, when the housing 21 is mounted on the panel 23, the retaining pawls 27 and the auxiliary pawls 29 are retainingly engaged with that edge portion of the mounting hole 25 facing in the inserting direction, and also the stoppers 31 are engaged with that edge portion of the mounting hole 25 facing away from the inserting direction. Thus, the housing is positively mounted on the panel 23, with the panel 23 held by the retaining pawls 27*a*, the auxiliary pawls 29 and the stoppers 31.

A pair of protective ribs 33 are formed on each of the upper, lower, right and left faces of the housings 21, and are disposed respectively on opposite sides of the corresponding retaining arm 27. The length of projecting of each pair of protective ribs 33 from the corresponding housing face is larger than that of the retaining arm 27. In other words, each retaining arm 27 is movably provided between the pair of protective ribs 33, and is disposed inwardly of the outer surfaces of these ribs 33. Notches 35 are formed respectively in those portions of the edge of the mounting hole 25 corresponding respectively to the protective ribs 33, and each notch 35 is larger in size than the protective rib 33 by an amount corresponding to the amount of movement of the housing 21 in the mounting hole 25.

When the movable connector 37 of the above construction is inserted in the mounting hole 25, the distal end portions of the retaining pawls 27 are received in the mounting hole 25, and also the protective ribs 33 are received in the notches 35, respectively. When the distal end portions of the retaining arms 27 begins to be received in the mounting hole 25, each retaining arm 27 is once elastically displaced toward the housing 21 through a slanting surface of the retaining pawl 27*a*, and then when the retaining pawl 27*a* passes past the mounting hole 25, the retaining arm 27 is elastically restored, so that the retaining pawl 27*a* is retainingly engaged with that portion of the edge portion of the mounting hole 25 facing in the inserting direction. At this time, the auxiliary pawls 29 are also brought into engagement with this edge portion. Simultaneously when the retaining pawls 27*a* are retainingly engaged with the edge portion of the mounting hole 25, the outwardly-projecting stoppers 31 are engaged with that side of the panel 23 facing away from the inserting direction, thereby preventing the housing 21 from being withdrawn in the direction of insertion of the housing 21.

The movable connector 37 thus mounted on the panel 23 is opposed to a mating connector projecting, for example, from an instrument panel, and when the instrument panel is fixed to the panel 23, the movable connector 37 is inserted into the mating connector. At this time, if the movable connector 37 is disposed out of registry with the mating connector, the retaining arms 27 of the movable connector 37 are displaced upward, downward, right and left as the mating connector approaches, thereby absorbing this misregistration. At this time, each pair of protective ribs 33, formed respectively on the opposite sides of the retaining arm 27, can be freely moved in the respective notches 35 each having such a size as to allow the movement of the housing 21, and will not prevent the movement of the housing 21 by contact with the panel 23.

When the movable connector 37 is thus mounted on the panel 23, each retaining arm 27 is covered with the associated protective ribs 33 over the entire length thereof, and therefore is prevented from contact with a foreign object. Therefore, in the condition in which the movable connector 37 is mounted on the panel 23, the retaining arm 27 will not be struck by a foreign object, and hence will not be damaged by it, and therefore the retaining engagement of the retaining arm will not be released. A foreign object, such as a wire harness, will not contact the retaining pawl 27*a* of the retaining arm 27, and therefore the retaining by the retaining pawl 27*a* will not be accidentally released.

In the above movable connector-mounting construction, the pair of protective ribs 33 are provided respectively on the opposite side of each retaining arm 27, and project outwardly beyond the retaining arm 27, and the notches 35 are formed respectively in those portions of the edge of the mounting hole 25 corresponding respectively to the protective ribs 33. Therefore, not only before but also after the movable panel 37 is mounted on the panel 23, each retaining arm 27 is covered with the protective ribs 33 over the entire length thereof, and therefore is protected from contact by a foreign object.

Each notch 35 is larger in size than the protective rib 33 by an amount corresponding to the amount of movement of the housing 21 in the mounting hole, and therefore during the time when misregistration is absorbed, each protective rib 33 will not interfere with the panel 23, and hence will not affect the displacement of the housing 21.

In the above embodiment, although the movable connector 37 is mounted on the panel 23 on a vehicle body, and is connected to the mating connector projecting from the instrument panel, the movable connector-mounting construction of the invention can, of course, be applied to the reverse case where the movable connector 37 is mounted on the instrument panel.

In the above embodiment, although the construction of the invention is used in the connector connecting portion between the instrument panel and the body panel, the movable connector-mounting construction of the invention can be suitably used in a connecting portion between a connector of an electric part, mounted on a door frame, and a connector of a door harness mounted on a door trim.

ADVANTAGEOUS EFFECTS OF THE INVENTION

As described above in detail, in the movable connector of the invention, the pair of protective ribs are formed respectively on the opposite sides of each retaining arm, and the notches are formed respectively in those portions of the edge of the mounting hole corresponding to the protective ribs. Therefore, even after the movable connector is mounted on the panel, each retaining arm is covered with the associated protective ribs over the entire length thereof, and a foreign object is prevented from contacting the retaining arm. As a result, damage of the retaining arm by interference with other member is prevented, and after the connector is retained, the retaining thereof will not be accidentally released, thereby enhancing the reliability of the movable connector-mounting construction.

What is claimed is:

1. A movable connector comprising:

a housing;

an elastic retaining arm, the elastic retaining arm including a front portion having a front edge and a rear portion, wherein the front portion has a height greater than the rear portion and the rear portion is formed on an outer surface of the housing, and displaceably retaining the movable connector; and a pair of protective ribs provided respectively on opposite sides of the retaining arm and projecting outwardly from the outer surface of the housing extending to a first point beyond the front edge of the front portion of the retaining arm and extending at the first point to a height greater than the height of the front portion of the retaining arm.

2. The movable connector according to claim 1, wherein the housing is of a rectangular parallelepipedic shape having four faces, and a face of the housing serves as a front face thereof, and a plurality of the retaining arms are formed respectively on four faces of the connector housing disposed adjacent to the front face thereof.

3. The movable connector according to claim 1, further comprising:

stoppers formed on a rear portion of the housing in a direction of insertion of the housing, and extending perpendicularly to the inserting direction.

4. A movable connector-mounting construction comprising a movable connector;

a panel on which the movable connector is mounted, the panel having a mounting hole whose opening has a size larger than an outer size of a housing of the movable connector to provide a gap between an edge of the mounting hole and the housing so as to enable the connector to be displaced;

an elastic retaining arm, the elastic retaining arm including a front portion having a front edge and a rear portion, wherein the front portion has a height greater than the rear portion and the rear portion is formed on an outer surface of the housing of the movable connector, and displaceably retaining the movable connector on the edge of the mounting hole; and a pair of protective ribs provided respectively on opposite sides of the retaining arm and projecting outwardly from the outer surface of the housing extending to a first point beyond the front edge of the front portion of the retaining arm and extending at the first point to a height greater than the height of the front portion of the retaining arm; and notches formed respectively in those portions of the edge of the mounting hole corresponding respectively to the protective ribs, and each of the notches being larger in size than the protective rib by an amount corresponding to the amount of displacement of the housing.

5. The movable connector-mounting construction according to claim 4, wherein the housing is of a rectangular parallelepipedic shape having four faces, and a face of the housing serves as a front face thereof, and a plurality of the retaining arms are formed respectively on each of the four faces of the connector housing disposed adjacent to the front face thereof.

6. The movable connector-mounting construction according to claim 4, further comprising:

stoppers formed on a rear portion of the housing in a direction of insertion of the housing, and extending perpendicularly to the inserting direction, and when the housing is inserted in the mounting hole, the stoppers are engaged with that side of the panel facing away from the inserting direction, thereby preventing the housing from being withdrawn in the inserting direction.

* * * * *